United States Patent [19]

Ndebi et al.

[11] Patent Number: 5,055,884

[45] **Date of Patent: * Oct. 8, 1991**

[54] ELECTROSTATOGRAPHIC EQUIPMENT WITH MULTIPLEX FUSER

[75] Inventors: Sylvain L. Ndebi; Robert D. Bobo, both of Rochester, N.Y.

[73] Assignee: Eastman Kodak Company, Rochester, N.Y.

[ * ] Notice: The portion of the term of this patent subsequent to Oct. 1, 2008 has been disclaimed.

[21] Appl. No.: 453,740

[22] Filed: Dec. 20, 1989

[51] Int. Cl.[5] ..... G03G 15/20

[52] U.S. Cl. ..... 355/282; 355/285; 355/288; 355/290; 355/295

[58] Field of Search ..... 355/282, 286, 285, 288, 355/295, 289, 290, 312; 219/469, 216

[56] References Cited

U.S. PATENT DOCUMENTS

| | | | |
|---|---|---|---|
| 3,452,181 | 6/1969 | Stryjewski | 219/216 |
| 3,566,076 | 2/1971 | Fantuzzo | 219/216 |
| 3,827,855 | 8/1974 | Blake | 355/289 X |
| 3,893,800 | 7/1975 | Wako | 432/60 |
| 4,403,847 | 9/1983 | Chrestensen | 355/312 X |
| 4,416,719 | 11/1983 | Horiuchi | 219/501 X |
| 4,473,290 | 9/1984 | Iwao | 355/290 |
| 4,501,483 | 2/1985 | Romansky et al. | 355/284 |
| 4,639,405 | 1/1987 | Franke | 430/124 |
| 4,780,078 | 10/1988 | Masui | 355/289 X |
| 4,791,447 | 12/1988 | Jacobs | 355/290 |

FOREIGN PATENT DOCUMENTS

| | | | |
|---|---|---|---|
| 0134442 | 11/1978 | Japan | 355/289 |
| 0126547 | 10/1979 | Japan | 355/288 |
| 0116067 | 9/1981 | Japan | 355/288 |
| 0172775 | 10/1983 | Japan | 355/288 |

*Primary Examiner*—A. T. Grimley
*Assistant Examiner*—Nestor R. Ramirez
*Attorney, Agent, or Firm*—Tallam I. Nguti

[57] ABSTRACT

An electrostatographic reproduction equipment such as a copier or printer including a multiplex fusing apparatus that has non-contact and cooperating contact fusing components. The fusing apparatus further includes controls for selectively operating it in a non-contact mode, or in a contact mode.

17 Claims, 2 Drawing Sheets

ELECTROSTATOGRAPHIC EQUIPMENT WITH MULTIPLEX FUSER

RELATED APPLICATIONS

This application is related to U.S. patent application Ser. No. 07/453,739, filed on even date herewith on 12/20/89, in the names of the same inventors Sylvain L. Ndebi and Robert D. Bobo, and entitled "ELECTROSTATOGRAPHIC EQUIPMENT HAVING A MULTIPLE FUNCTION FUSING AND IMAGE TRANSFER ROLLER".

BACKGROUND OF THE INVENTION

This invention relates to equipment for electrostatographically producing or reproducing copies of an original image onto a suitable substrate. More particularly, the invention relates to such an equipment having a multiplex fusing apparatus that handles and fuses toner images, with excellent results, onto a variety of substrates including printing press master plates.

Electrostatographic process equipment, such as copiers and printers, are well known. In these types of equipment, image patterns of an original image are formed electrostatically on an image bearing member, developed thereon with fusible toner particles, and then transferred onto a selected substrate for fusing.

In such equipment, it is well known to use heated rolls, at least one of which contacts the toner image, for such fusing. In some cases, however, it is not desirable to make any type of contact with the toner images during fusing. In some of such cases, it is also well known to use separate non-contact heat fusing apparatus for fusing such toner images on substrates. Such non-contact apparatus conventionally include a flat belt device for transporting the toner image carrying substrate past a radiant heat source. Unfortunately however, when substrates are handled as such through such non-contact fusing apparatus, the substrates ordinarily tend to curl and corrugate thereby resulting in uneven fusing as well as undesirably looking copies. Unfortunately too, contact fusing apparatus on the other hand also tend to restrict dimensional changes (expansion or contraction) of substrates during the contacting and pressing that occurs within the fusing nip, thereby resulting in undesirable shape distortion, especially in the case of polymeric substrates.

Yet, quality contact and/or non-contact fusing remain desirable alternatives, and may even be imperative, depending on the substrate being used, and the output copy desired. Unfortunately however, a reproduction equipment that includes separate components for both contact and non-contact fusing will tend to be elaborate, and to be relatively more expensive.

SUMMARY OF THE INVENTION

It is an object of the present invention to provide a piece of electrostatographic reproduction equipment that can handle, and fuse toner images on, a variety of substrates, for example, plain and coated paper, plain and coated plastic film, and printing press metallic plates.

It is another object of the present invention to provide an electrostatographic piece of equipment that is capable of performing non-contact as well as contact fusing.

In accordance with the present invention, an electrostatographic reproduction equipment is provided for producing fused toner images on a variety of substrates, for example, paper, plastic film and metallic printing press master plates. The reproduction equipment includes (a) means for electrostatically forming image patterns of an original image on an image bearing member, (b) means for developing such image patterns with fusible toner particles to form a toner image, (c) means for transferring the toner image to a substrate, and (d) a multiplex or multiple mode fusing apparatus for fusing the toner image to such substrate.

The multiplex or multiple mode fusing apparatus further includes (i) non-contact fusing means for fusing toner images onto a substrate without contacting the images, (ii) contact fusing means for fusing and fixing toner images by contacting and pressing the images onto the substrate, and (iii) control means for selectively operating such multiplex fusing apparatus in a non-contact mode such that toner images on a substrate are fused only by the non-contact means, or in a contact mode such that such toner images are fused and fixed by the cooperating contact means.

BRIEF DESCRIPTION OF THE DRAWINGS

In the detailed description of the preferred embodiment of the invention described below, reference is made to the accompanying drawings in which.

DETAILED DESCRIPTION OF THE PREFERRED EMBODIMENT

Figure 1:
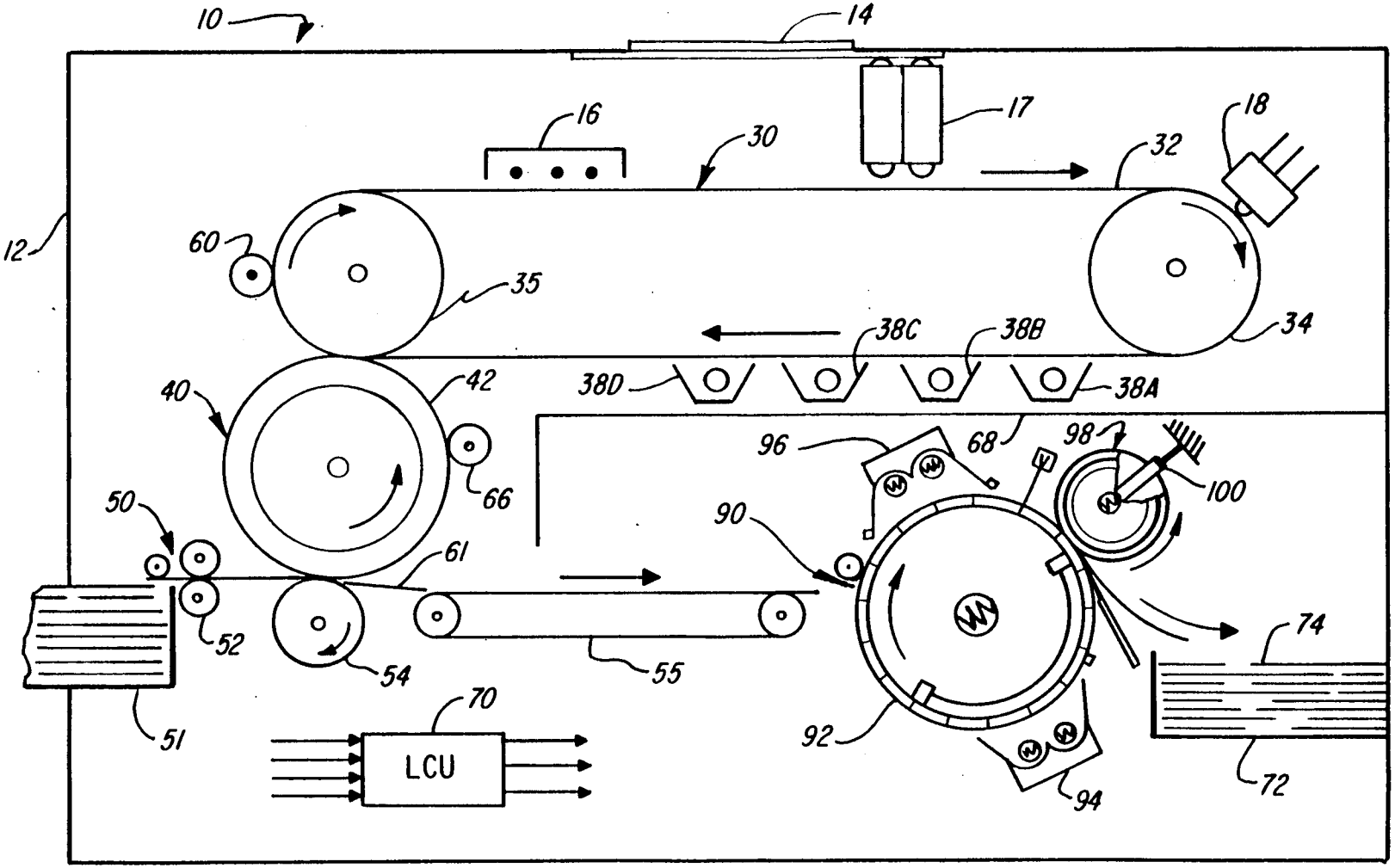
FIG. 1 is a schematic view of an electrostatographic equipment such as a copier or printer having a photoconductor and an image transfer member, and including the fusing apparatus of the present invention.

Referring to FIG. 1, an electrostatographic piece of equipment, such as a copier or printer 10 for producing or reproducing copies of images in any of the manners known in the art, is shown. The copier or printer 10 includes a frame or housing 12, an original document handling platen 14, a primary charger 16, a scanner 17, and an image writing means such as an electronic printhead 18. The copier or printer 10 also includes an image bearing member 30 having an image bearing surface 32, as well as, four development stations 38A, 38B, 38C and 38D. The development stations each carry toner particles of a different color. As is well known in the art, image patterns of an original image, including color separation image patterns of such an original image, can be formed electrostatically on the surface 32 and then developed or made visible with the toner particles at any of the development stations.

The copier or printer 10 further includes an image transfer member 40 having a surface 42, a substrate or copy sheet feed system 50, and a logic and control unit 70. As is also well known, the toner particle images, formed as above on the surface 32, can be transferred to a substrate 51, that is fed by the system 50, by using the transfer member 40.

For such image transfer, the substrate 51 is fed from a supply of such substrates as shown by a set of rollers 52. In the present invention, the substrate 51 can be plain or coated paper, plain or coated polyester film or aluminum plates for making masters for use on electrographic, lithographic and phototypesetting printing devices. The substrate 51 when fed, is urged into registered contact with the member 40, for example, by means of an articulating roller 54. After such image transfer to the substrate 51, the result, as shown, is an image carrying substrate 61 that is thereafter moved for fusing by a conveyor system 55 towards the fusing station 90 of the present invention. Thereafter, the transferred image can be fused onto such substrate by means of a fusing apparatus, for example, the fusing apparatus of the present invention denoted generally as 90. The fusing apparatus of the present invention may be located as shown, separated from the development stations by a portion 68 of the housing or frame 12.

Still referring to FIG. 1, a first cleaning element 60 is shown for cleaning the surface 32 of the image bearing member 30, after the images thereon have been transferred using the member 40. A second cleaning element 66 is also shown. Cleaning element 66 is used for cleaning the surface 42 of the member 40, and as such, is located downstream of the point of image transfer from the surface 42 to the substrate 51. The element 66 further includes means (not shown) for selectively moving the element 66 into and out of cleaning engagement with the surface 42 in order to avoid damage to an image on such surface.

The quality of copies and printing press master plates made by the copier or printer 10 depends on the effectiveness of these cleaning elements, but more importantly, on the effectiveness of the fusing apparatus 90 and the cleanliness of the fused printing press master plates it produces.

Figure 2:
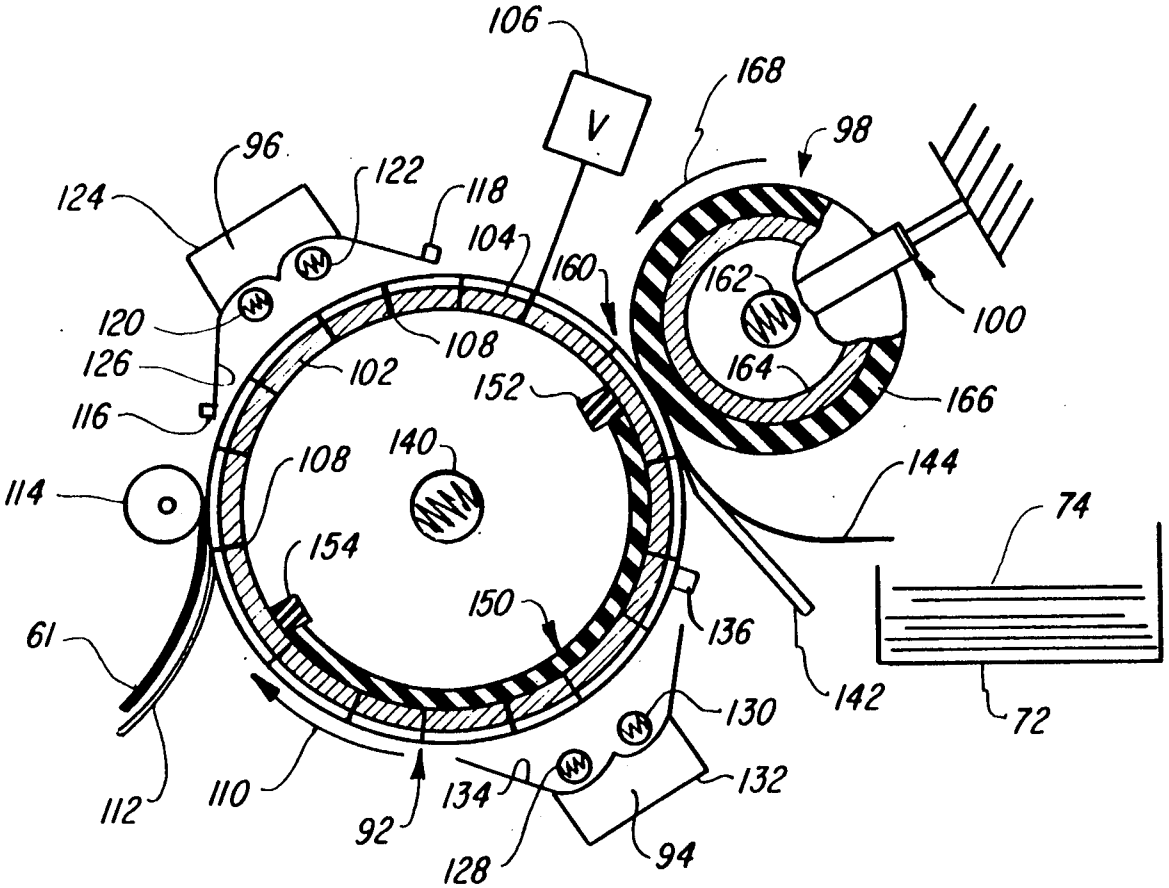
FIG. 2 is an enlarged view, partly in section, of the fusing apparatus of FIG. 1.

Referring now to FIGS. 1 and 2, the fusing apparatus 90 of the present invention is connected to, and is controlled through the logic and control unit (LCU) 70. As illustrated, the apparatus 90 includes non-contact fusing means as well as contact fusing means cooperating with the non-contact means. The non-contact means includes a substrate transport drum 92, and first and second external radiant heat sources 94, 96. The contact means includes the transport drum 92 and a heated fuser roller 98. The fuser roller 98 cooperates with the drum 92 and as shown, includes an articulating device 100 for moving the roller 98 into, and out of nip engagement with the transport drum 92. With the control of the LCU 70, the non-contact and contact fusing means can each be selectively, and separately, operated for fusing images on an image carrying substrate 61.

As shown, the substrate transport drum 92 consists of a rigid metallic shell 102 that is made for example of aluminum. The shell 102 may include an outer surface area that is suitable for attaching an image carrying substrate 61 thereto. The drum 92 may also include a thermally conductive elastomeric layer 104 over the shell 102, in which case, such an overlayer 104 will include the outer surface area for attaching the substrate 61. The shell 102, with the layer 104 bonded thereto, is rotatable by suitable means, for example, in the clockwise direction as indicated by the arrow 110.

Drum 92 as shown is hollow, and generally cylindrical. Its ends are vacuum sealed, and one end thereof includes means for connecting a vacuum source thereto. Structurally, drum 92 should be long enough to handle the largest cross-dimension image carrying substrate 61 to be transported. For example, if it is expected to transport 17"×11" substrates lengthwise, then drum 92 should at least be longer than 17". Furthermore, the drum 92 should have a large diameter relative to the leading-to-trailing edge dimension of the substrate so as to prevent the introduction of an undesirable curl in such substrate.

The drum 92 further includes means for holding the substrate 61 thereto. Such holding means, for example, can be a vacuum source 106 that is appropriately connected to one end of the drum 92. The vacuum source 106, when activated, will pull air from the outside of the drum 92, through a pattern of holes 108, into, and through the hollow of the drum 92. The holes 108 are formed over the entire surface area of the drum 92, and are aligned through both the elastomeric layer 104 and the shell 102. In addition, the holes 108 are formed in a regular grid pattern of longitudinal rows and circumferential columns.

The rows and columns of the holes 108 are spaced such that when the leading edge of an image carrying substrate 61 is placed just over a row of holes, the lateral edges of such a substrate will each just lie over a column of holes, and the trailing edge of the substrate too will also just lie over another row of such holes. Because the holes are over the entire surface of drum 92, an image carrying substrate 61 overlaying an area of such surface, as described here, will also overlay a portion of the grid pattern of such holes 108. The effect of the activated vacuum source 106 will therefore be to attempt to pull air into the drum 92 through the holes overlayed by the substrate 61. As a result, the vacuum effect will pull down, and tightly hold the leading edge, and eventually the rest of the image carrying substrate 61, against the outside surface of the drum 92 and at a uniform cross distance from the radiant heat source 96.

The substrate 61 may be fed as such onto the drum 92 by means of a gate (not shown), and a deflector ramp 112. Additionally, an edge contact mechanical device 114, such as a roller in nip engagement with the rotating drum 92, may be used to further flatten the image carrying substrate 61 against the drum 92 through contact with each lateral edge of the substrate. Such a device 114 may be positioned at each end of the drum 92 where it contacts only a portion of the non-image lateral edge of the image carrying substrate 61. A substrate 61 therefore can be picked up and held as such by activating the vacuum source 106, and by rotating the drum 92 into position for receiving such substrate 61 from the conveyor system 55.

After picking up and holding a substrate 61 as such, continued rotation of the drum 92 will bring the leading, and eventually the trailing edge of such substrate (a) past a first sensor 116, (b) completely through the second radiant heat source 96, and (c) past a second sensor 118. The sensors 116 and 118 function to turn the heat source 96 on and off in relation to the movement of such substrate 61.

As illustrated, the radiant heat source 96 which is longitudinally coextensive with the drum 92, includes longitudinally extending infrared lamps 120, 122. Lamps 120, 122 are selected so as to be capable of emitting infrared flux within a range including wave lengths less than 2 micrometers. Infrared wavelengths below 2 micrometers are absorbable by the colored toner particles, but are not readily absorbable, for example, by paper substrates. Consequently, when substrates such as paper are being run, substantially all the heat emitted by the source 96 will be used up in heat melting or fusing the toner images on such substrate. As such, the fusing apparatus 90 is relatively very heat efficient since the source 96 only needs to be capable of raising the temperature of the toner images to their melting or fusing point.

The source 96 also includes an insulative hood 124, which has a reflective inner surface 126 about the lamps 120, 122. The hood 124 serves to reflect and concentrate the heat emitted by the lamps 120, 122 onto the toner images on the substrate 61. The hood 124 therefore also contributes to the heat efficiency of the apparatus 90. Furthermore, in order to ensure the heat efficiency of the source 96 when fusing at wave lengths, for example, greater than 2 micrometers, the outside surface of the drum 92 is preheated by the other radiant heat source 94. Drum 92 is preheated as such to a temperature that is less than, or as high as, the melting or fusing temperature of the particular toner being used. To enhance such preheating at all wavelengths, the outside surface of the drum 92 is painted black.

As illustrated, the preheating heat source 94 is similar to the source 96 in that it also includes a pair of infrared lamps 128, 130, and an insulative hood 132 with a reflective inner surface 134. However, the flux emitted by the lamps 128, 130 is not restricted to any particular wavelength range. Additionally, the on and off cycling of the lamps 128, 130 may be controlled conventionally by means of the LCU 70 and a surface temperature sensor 136.

The preheating of the drum 92 by the source 94 also serves to preheat the image carrying substrate 61, being transported thereon. When such substrate is picked up and held tightly against the preheated black surface of the device 92, the substrate ordinarily will be preheated by the time it passes under the heat source 96. In the present invention, such preheating of the substrate 61 is particularly effective due to the vacuum effect of the source 106 which exhausts and removes substantially all the air that would otherwise have been an insulative layer between the substrate 61 and the outside surface of the drum 92. For this reason, the vacuum means 106, as a means for holding the substrate 61 to the drum 92, is therefore preferable over other means such as gripping fingers.

Preheating the toner image carrying substrate 61 as such has been found to enhance the fused quality of the images. This is because such preheating substantially evens out the rate of retention of absorbed heat between high and low toner density image areas on the substrate, as such areas pass under the heat source 96. Without such preheating, a high toner density image area, even while losing absorbed heat to the unheated substrate, tends to retain a sufficient quantity of such absorbed heat within the dense mass or agglomeration of its toner particles, thereby enabling adequate fusing of such toner mass or agglomeration. Unfortunately however, a low toner density image area, without comparable toner particle mass or agglomeration, tends instead to quickly lose its absorbed heat to the unheated substrate, and as a consequence, it retains very little of such heat, and therefore results in poor or inadequate fusing of such toner.

Additionally, the preheating and temperature control of the outside surface of the drum 92 (and hence the desirable preheating of the substrate 61) can also be improved by means of an auxiliary heat source 140, such as a quartz lamp. The source 140 for example, may be used simply for keeping the hollow of the drum 92 warm.

In the present invention, the preheating of the image carrying substrate 61 also serves to advantageously heat relax the substrate prior to it being subjected to the relatively high fusing heat of the source 96, for example. Such heat relaxation is particularly important in the case of plastic film substrates which are susceptible to a significant "wavy" or "corrugated" surface distortion when subjected to such fusing heat without prior heat relaxation.

Using plastic film substrate plates that are adequately thick, for example, seven to nine mils, and heat relaxing them as above, have been found to substantially reduce such distortion. In addition, it has also been found that such distortion will be further reduced or eliminated by feeding such plastic film plates, for pick up by the transport drum 92, such that the machine oriented polymer chains of the plates or substrates are perpendicular to the longitudinal axis of the drum 92.

As described above, the fusing apparatus 90 is capable of being operated effectively in a non-contact mode when the device 100 retracts and keeps the fusing roller 98 spaced from the transport drum 92. With the roller 98 retracted as such, toner image carrying substrates 61 which are picked up and held by the drum 92, can thus be moved without contact, past the fusing lamps 120, 122, and until removed from the drum 92 by means, such as a mechanical skive 142. Such a substrate 61 can, if necessary, be directed from the skive 142 by guide means 144 into an output tray 74.

Such non-contact fusing capability of the apparatus 90 is particularly useful for producing paper, plastic, and metallic offset printing press masters. It has been found that such masters are ordinarily susceptible to dimensional distortion, oil contamination, and toner image offset, if contacted by a contact fuser roller. The oil contamination, for example, can come from release oil such as is typically used on the surface of contacting fuser rollers. On an offset printing press master plate, such oil contamination will cause press ink to reach intended "no print" areas of the press blanket, thereby resulting in defective press-produced copies. In the present invention however, such masters are produced in the non-contact mode, and are therefore substantially free of such oil contamination, as well as of other contact fusing related defects such as dimensional distortion and toner offset.

For removing the fused substrate 61, from the drum 92, the apparatus 90 may additionally include a stationary vacuum barrier device 150. The device 150 is mounted, as shown, inside the drum 92, and to the side opposite the fusing heat source 96. The device 150 is only wide enough to cover a predetermined portion of the inside surface of the shell 102 of drum 92. It additionally includes vacuum shields 152 and 154 which effectively seal against the inside of the rotating shell 102, thereby preventing vacuum effect or action through any holes 108 traveling over the barrier 150, between such seals 154, 152.

As such, air is pulled into the hollow of the drum 92 only through such holes 108 that are traveling clockwise as shown, from the shield 154, past the heat source 96, and to the shield 152. Such a vacuum effect will of course hold an image carrying substrate 61 tightly against the surface of the drum 92 from its pickup point, and until it reaches its removal point near the shield 152. After that, further rotation of the drum 92 past the shield 152 will cause the holes 108 underneath the substrate 61 to lose vacuum. Such loss of vacuum first frees the leading edge of the substrate, and eventually the whole substrate, as the drum 92 continues to rotate, thereby enabling the substrate 61 to be easily skived off by the means 142 at such point.

Another advantage of the vacuum barrier 150 is to enhance the hold down effectiveness of the vacuum source 106 on the substrate 61, by concentrating the air intake of the source 106 only through the holes 108 traveling from the shield 154 to the shield 152.

As also described above, the fusing apparatus 90, can also be selectively operated in a contact mode when the device 100 extends and keeps the fuser roller 98 in contact engagement with the drum 92. When extended into such contact engagement, the heated fuser roller 98 forms a fusing nip 160 with the drum 92 such that the nip is suitable for performing contact fusing and fixing of toner images onto the image carrying substrate 61. For such contact fusing, the substrate 61 is initially picked up and vacuum held during transportation by the drum 92 in exactly the same manner as it is handled for non-contact fusing. As such, the contact fusing means of the apparatus 90 are not separate from the non-contact fusing means, but are cooperative therewith.

As shown, the roller 98 can be a conventional fuser roller that may be heated externally by a suitable heat source, or internally by a heat source 162. As such, the roller 98 may consist of a thermally conductive core 164 and an overcoat layer 166 of a thermally conductive, compliant elastomer, for example, silicone rubber. For such nip contact fusing, the roller 98 is rotatable, for example, in the direction of arrow 168 so as to cooperate with the drum 92 to fuse, fix and feed a substrate 61 through the nip 160. Such feeding is effective even after the vacuum effect has been cut from such substrate 61 by the vacuum barrier 150. The shield 152 may therefore be located at or just downstream of the center of the fusing nip 160.

When operating the apparatus 90 in the contact mode, toner images on a substrate 61 (on the drum 92) may be heated to their melting or fusing point by either the heat source 96 or the heated fuser roller 98, or by a combination thereof. Additionally, the preheat source 94 may or may not be used. The fuser roller heat source 162, which can be a quartz lamp, must therefore be capable of heating the fuser roller 98 so that the temperature of its surface can be controlled conventionally at the fusing temperature of the particular toner being used.

As is well known, release oil may also be applied to the surface of the fuser roller 98, for example, by means of a wicking means 170. Additionally, the substrate 61, after exiting the fusing nip 160, may be removed from the surface of roller 98 by the aid of a skive 172. The surface of the roller 98 may also be specially textured in order to impart a desired finish to, or for glossing, the image being fused.

As pointed out, when the fusing apparatus 90 is operating in the contact mode, the fuser roller 98 will be held in the required nip forming contact with the drum 92 by means of the articulating device 100. The device 100 can, for example, be an air cylinder, or other suitable mechanical or electromechanical device. Accordingly it should be connected to the roller 98 and to the LCU 70 so that it can be selectively actuated to move the roller 98 into, or out of engagement with the drum 92.

As can be seen, the present invention provides a cost effective copier or printer 10 that is capable of producing ordinary finished copies of original images on plain or coated paper, on transparencies, and on other suitable substrates such as plastic film and metallic plates. Given its particular substrate transport drum 92, the fusing apparatus 90 of the present invention is particularly suitable for handling such a variety of substrates.

Additionally, the apparatus 90 is selectively capable of operating in either a contact mode for producing the finished copies, in a non-contact mode, or in a combination thereof. In the non-contact mode, the apparatus 90 is particularly suitable for producing printing press masters, such that the masters are free of contact-related defects, for example, dimensional distortion, oil contamination, and toner offset. Furthermore, the preheated transport device 92 of the apparatus 90, and the vacuum hold down means for a substrate 61 on such device, cooperate effectively to enhance the fusing quality, and the heat efficiency of the apparatus 90.

What is claimed is:

1. An electrostatographic reproduction equipment for producing fused toner images on a variety of substrates, the reproduction equipment including:

(a) means for electrostatically forming image patterns of an original image on an image bearing member;

(b) means for developing such image patterns with fusible toner particles to form a toner image;

(c) means for transferring the toner image to a substrate; and (d) a single multiplex or multiple mode fusing apparatus comprising:

(i) non-contact fusing means for completely fusing toner images onto such a substrate without contacting such image;

(ii) contact fusing means for completely fusing and fixing toner images by contacting and pressing the images onto such a substrate; and (iii) control means for selectively operating said multiplex or multiple mode fusing apparatus in a non-contact mode such that toner images on such a substrate are fused only by said non-contact fusing means, or in a contact mode such that toner images on such a substrate are fused and fixed by said contact fusing means.

2. The fusing apparatus of claim 1 wherein said non-contact fusing means includes:

(a) means, including a drum for receiving and transporting such a toner image carrying substrate through said apparatus; and (b) a radiant heat source about said drum for non-contact heating and fusing of the toner images on said substrate.

3. The fusing apparatus of claim 1 wherein said contact fusing means includes:

(a) a fuser roller for forming a fusing nip with transport means for receiving and transporting the toner image carrying substrate;

(b) means for heating said fuser roller so as to raise the temperature of the outer surface thereof to a desired point suitable for toner fusing; and (c) control means for moving said fuser roller from an out of contact position in which said fuser roller is spaced from said transport means, into a contact position in which said fuser roller is in nip forming contact with said transport means.

4. The fusing apparatus of claim 1 wherein said control means includes;

(a) a movable fuser roller, moving means for selectively moving said fuser roller between a first position in which said roller forms a contact fusing nip with a substrate transport drum, and a second position in which said roller is out of contact with said transport drum; and (b) a programmable logic and control means connected to said moving means for controlling the movement of said fuser roller between said first, contact position, and said second, out-of-contact position.

5. The fusing apparatus of claim 2 wherein said means for receiving and transporting a toner image carrying substrate therethrough comprises:

(a) a transport drum consisting of a rotatable shell, said drum having sealed ends, heating means and an outer surface area for attaching the image carrying substrate thereto;

(b) vacuum means connected to said drum for creating a vacuum inside said drum; and (c) holes formed through said shell, communicating between said outer surface area and said inside of said drum.

6. The fusing apparatus of claim 2 including a plurality of said radiant heat sources positioned in heating relationship about said substrate transport means.

7. The fusing apparatus of claim 3 wherein said means for moving said fuser roller consists of a pneumatic air cylinder.

8. The fusing apparatus of claim 5 wherein said outer surface area of said drum is painted black for improved heat absorption.

9. The fusing apparatus of claim 5 wherein said means for receiving and transporting a substrate therethrough further includes a stationary vacuum barrier positioned inside said drum to be against a portion of the inside surface of said rotatable shell for preventing vacuum action through holes in that portion of said outer surface area corresponding to said inside portion of the shell against said vacuum barrier.

10. The fusing apparatus of claim 5 wherein said transport drum further includes an elastomeric overlayer bonded over said shell for rotation therewith, said overlayer having holes therethrough corresponding to, and aligned with, said holes in said shell.

11. The fusing apparatus of claim 5 wherein said means for receiving and transporting a substrate therethrough further includes a substrate flattening member positioned in nip engagement with the end edges of the outside surface of said drum for deflecting the toner image carrying substrate into contact with said outside surface.

12. The fusing apparatus of claim 5 wherein said transport drum has a large diameter relative to the lead edge-to-trailing edge dimension of the image carrying substrate being transported so as to minimize the tendency of said drum to introduce a curl in such substrate.

13. The fusing apparatus of claim 6 wherein said plurality of radiant heat sources includes;

(a) a first source for preheating said substrate transport means prior to said transport means picking up the image carrying substrate, and (b) a second source for heating and fusing the toner images on such substrate.

14. The fusing apparatus of claim 9 wherein said stationary vacuum barrier, relative to a substrate being transported by said drum, is positioned within the drum so as to start the prevention of vacuum action at a point where fusing of the toner images on such substrate is substantially completed so that the substrate is ready to be removed from said drum.

15. The fusing apparatus of claim 13 wherein said second source of radiant heat is capable of emitting infrared flux having a wavelength less than two micrometers so as to maximize heat absorption by the toner images while minimizing heat absorption by paper type substrates.

16. The fusing apparatus of claim 13 wherein said first and said second sources of radiant heat each includes a radiant heat reflector for reflecting and concentrating emitted heat onto the toner images on the image carrying substrate.

17. The fusing apparatus of claim 13 further including first and second sensors for activating and deactivating said second source of radiant heat in response to an image carrying substrate being transported past said second source.

* * * * *